US006568230B1

(12) United States Patent
Chen

(10) Patent No.: US 6,568,230 B1
(45) Date of Patent: May 27, 2003

(54) LOCK CORE MECHANISM WITH ALARM FUNCTION

(76) Inventor: Tian-Yuan Chen, P.O. Box 90, Tainan City (TW)

( * ) Notice: Subject to any disclaimer, the term of this patent is extended or adjusted under 35 U.S.C. 154(b) by 0 days.

(21) Appl. No.: 10/145,786

(22) Filed: May 16, 2002

(51) Int. Cl.[7] ..... E05B 45/10

(52) U.S. Cl. ..... 70/419; 70/432; 70/439; 70/DIG. 30; 70/DIG. 49; 200/43.08; 340/426

(58) Field of Search ..... 70/419, DIG. 49, 70/DIG. 30, DIG. 59, 439, 432, 441; 340/426; 200/43.08

(56) References Cited

U.S. PATENT DOCUMENTS

| | | | | |
|---|---|---|---|---|
| 1,748,255 A | * | 2/1930 | Tibbetts | |
| 1,809,368 A | * | 6/1931 | Winning | |
| 2,623,959 A | * | 12/1952 | Jarrett | |
| 2,695,932 A | * | 11/1954 | Jacobi | |
| RE24,434 E | * | 2/1958 | Miller | |
| 3,239,615 A | * | 3/1966 | Schink et al. | |
| 3,629,530 A | * | 12/1971 | Fischer | 200/44 |
| 3,793,497 A | * | 2/1974 | Di Gaetano | 70/239 X |
| 4,148,202 A | * | 4/1979 | Wegrzyn | 70/431 |

FOREIGN PATENT DOCUMENTS

| | | | | |
|---|---|---|---|---|
| DE | 2708141 | * | 8/1978 | 70/DIG. 49 |
| FR | 2248391 | * | 5/1975 | 70/DIG. 49 |
| WO | WO93/13967 | * | 7/1993 | 70/419 |

* cited by examiner

*Primary Examiner*—Lloyd A. Gall

(57) ABSTRACT

A lock core mechanism with alarm function in the invention comprises a lock core body having a core plate disposed therein, a projecting rod, a core cover-plate, a housing, an electric circuit plate, a follower member, and an actuating elastic assembly having a contact member and an elastic member. The electric circuit plate will sound when a picking tool is inserted to push the projecting rod downwards to touch against an actuating piece of the electric circuit plate, or when a special tool is inserted to forcedly rotate the follower member to make the elastic member touch against the contact member. The electric circuit plate will not be activated to sound for alarm only when a matching key is inserted to push the projection rod downwards to touch against the actuating piece, and simultaneously turned to rotate the follower member to make the elastic member touch against the contact member.

2 Claims, 5 Drawing Sheets

LOCK CORE MECHANISM WITH ALARM FUNCTION

BACKGROUND OF THE INVENTION

1. Field of the Invention

This invention relates to a lock core mechanism with alarm function, particularly to one having a lock core body provided with a core plate therein, a projecting rod, a core cover-plate, a housing, an electric circuit plate with buzzing function, a follower member and an actuating elastic assembly provided with an actuating member and a contact member, whereby the electric circuit plate will not be activated to sound for alarm only when a matching key is inserted in a keyhole of the lock core body to push the projection rod downwards to touch against an actuating piece of the electric circuit plate, and simultaneously turned to rotate the core plate to make the follower member roll over and press the elastic member downwards to touch against the contact member. Otherwise, the electric circuit plate will sound when a picking tool is inserted to push the projecting rod downwards to touch against the actuating piece without making the elastic member touch against the contact member, or when a special tool is inserted to forcedly rotate the follower member to roll over and press the elastic member downwards to touch against the contact member without making the projecting rod touch against the actuating piece.

2. Description of the Prior Art

Generally speaking, most known conventional locks simply use a key for locking and unlocking. At present, locks are designed to be provided with complicated structures for achieving the anti-theft purpose. However, no matter how complicated these known locks are constructed, such locks only can delay the time of being unlocked by thieves and has no way to stop such illegal unlocking of the thieves because the lock cores of such locks are still easily pried open by skilled thieves with special tools or mater keys in a short time, thus losing the anti-theft function.

SUMMARY OF THE INVENTION

The main purpose of the invention is to offer a lock core mechanism with alarm function by having a lock core body equipped with an alarm device therein and adapted to be assembled in any locks to sound for alarm when activated, thereby achieving the purpose of scaring away thieves so as to prevent anything from being stolen.

The main feature of the invention is to provide a lock core mechanism with alarm function mainly including:

a lock core body having a keyhole formed in one end thereof and a core plate disposed therein, the core plate capable of being rotated under a turning movement of a key and having a combining hole formed in a center thereof and an elongated hole formed proximate a circumferential edge thereof;

a projecting rod passing through the core plate of the lock core body and having a retaining portion disposed at an upper portion thereof and a spring located between the retaining portion of the projection rod and the core plate of the lock core body and allowing the projecting rod to move telescopically under a downward movement of the key;

a core cover-plate fitly covered in the lock core body and extended through by the projecting rod, the core cover-plate having a through hole and an aperture, the aperture provided to be extended through by the projecting rod;

a housing connected with the lock core body and having a supporting ridge disposed in an inner wall thereof;

an electric circuit plate fixedly attached to a bottom of the supporting ridge of the housing and having a through hole, an actuating piece corresponding in location to the projecting rod, and at least one alarm unit;

a follower member accommodated in the housing and having an axle rod extending upwards from an upper surface thereof and a block disposed on a lower surface thereof, the axle rod passing through the electric circuit plate and the core cover-plate, and then being firmly engaged with the core plate of the lock core body; and, an actuating elastic assembly engaged in an inner wall of the housing and having a contact member and an elastic member, the contact member provided to be contacted with the electric circuit plate.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
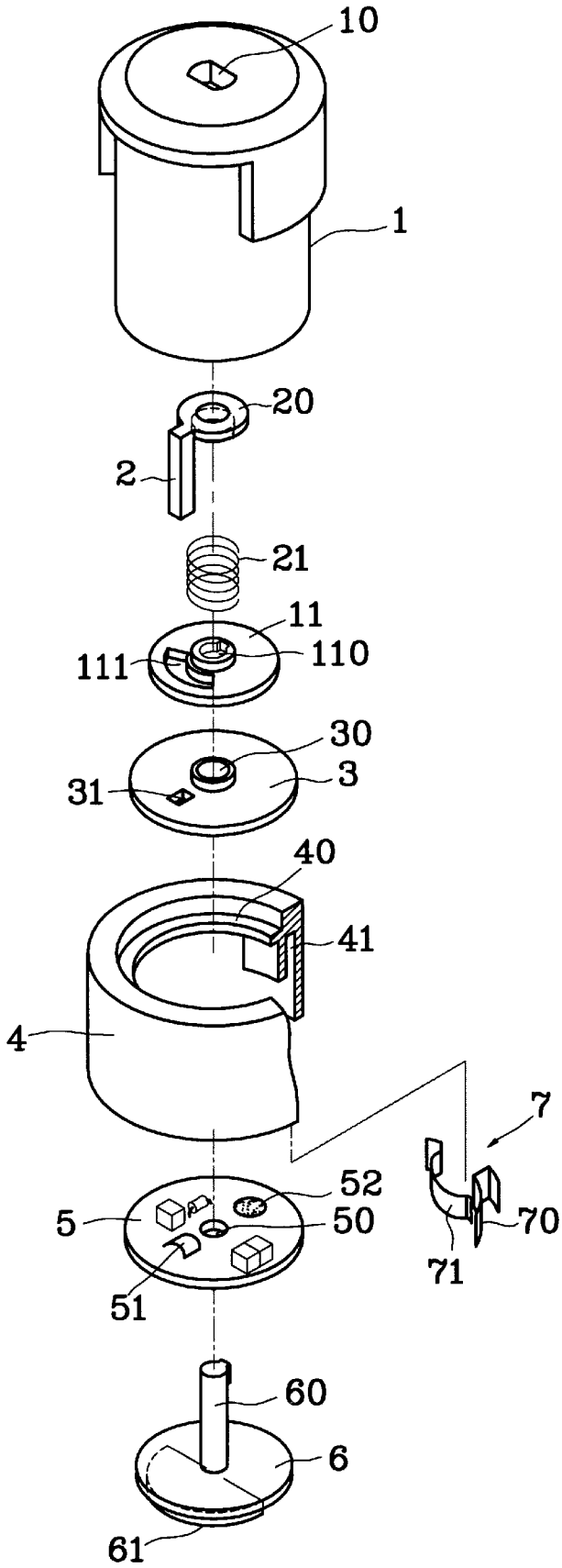
FIG. 1 is an exploded perspective view of a lock core mechanism with alarm function in the present invention.
Figure 2A:
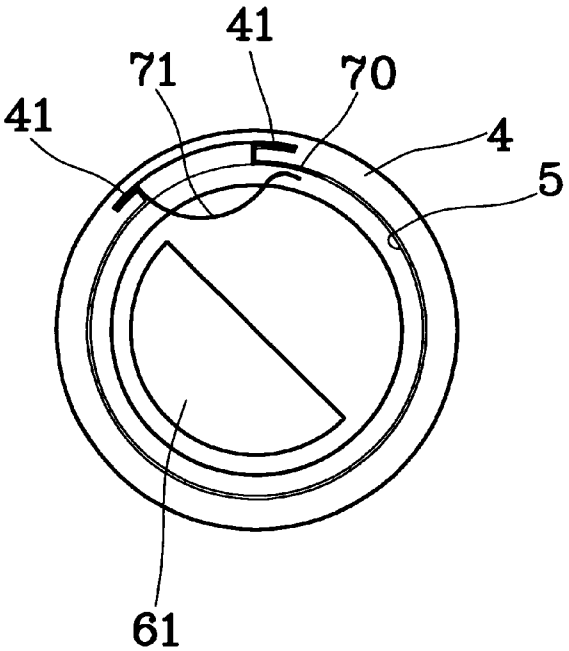
FIG. 2A is a side view of FIG. 2 in the present invention.
Figure 2:
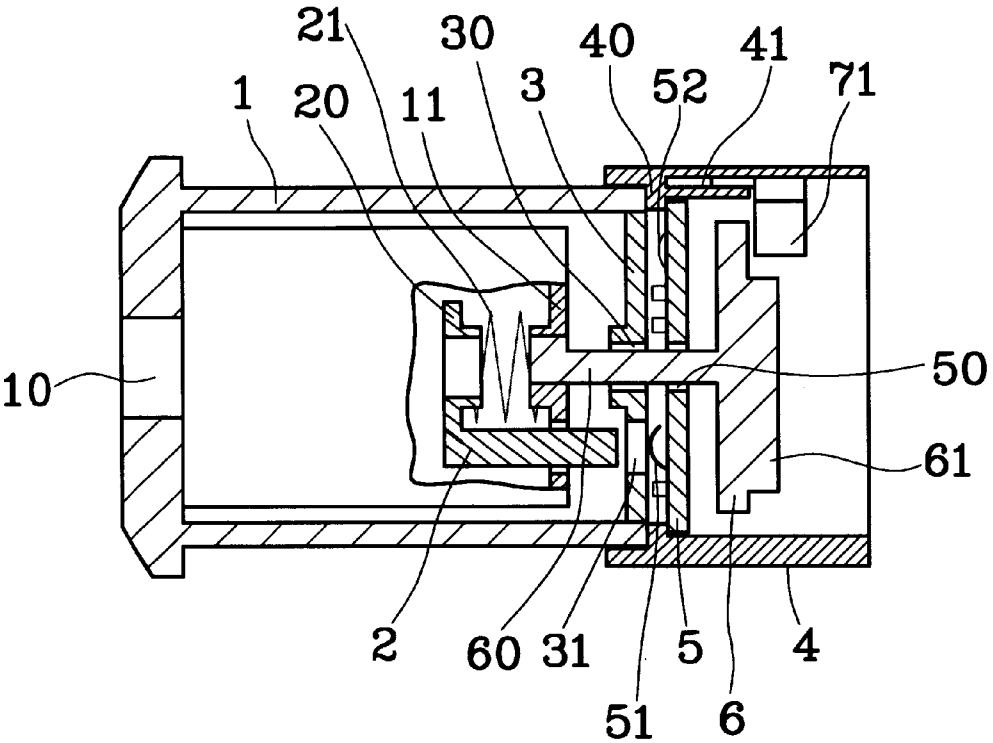
FIG. 2 is a sectional view of the lock core mechanism with alarm function in the present invention.
Figure 3A:
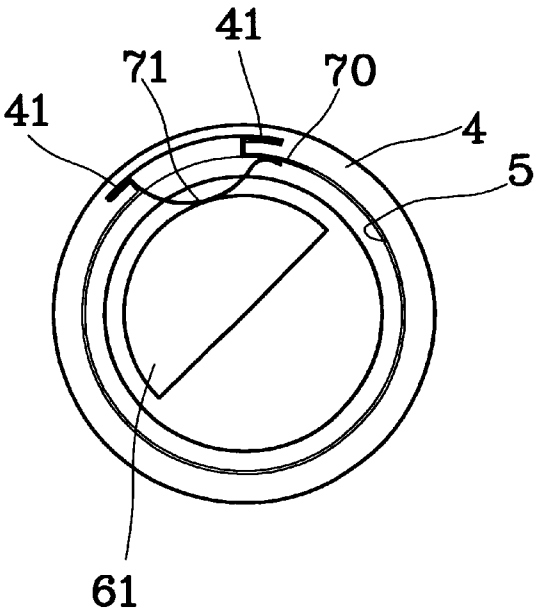
FIG. 3A is a side view of FIG. 3 in the present invention.
Figure 3:
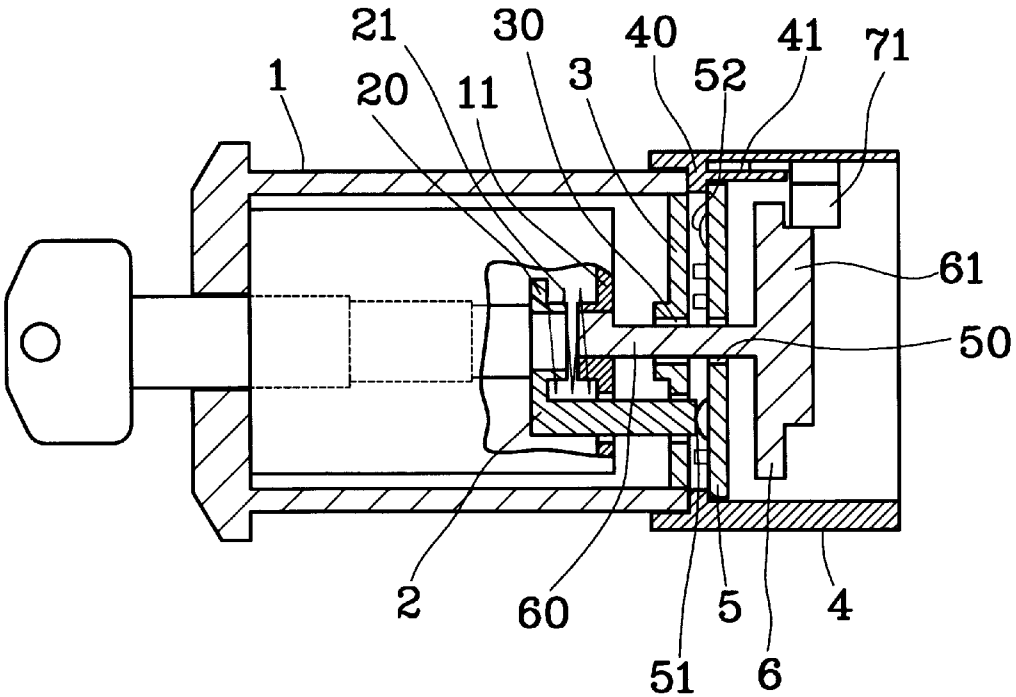
FIG. 3 is a schematic sectional view of the lock core mechanism with alarm function in the present invention being normally unlocked by a match key.
Figure 4A:
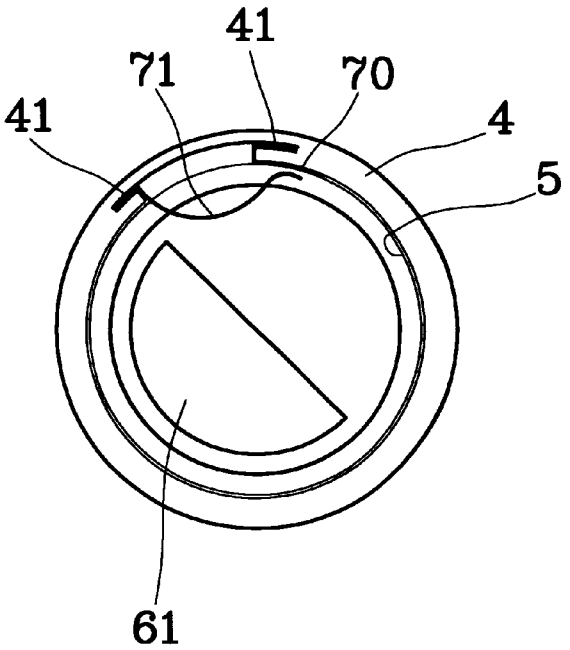
FIG. 4A is a side view of FIG. 4 in the present invention.
Figure 4:
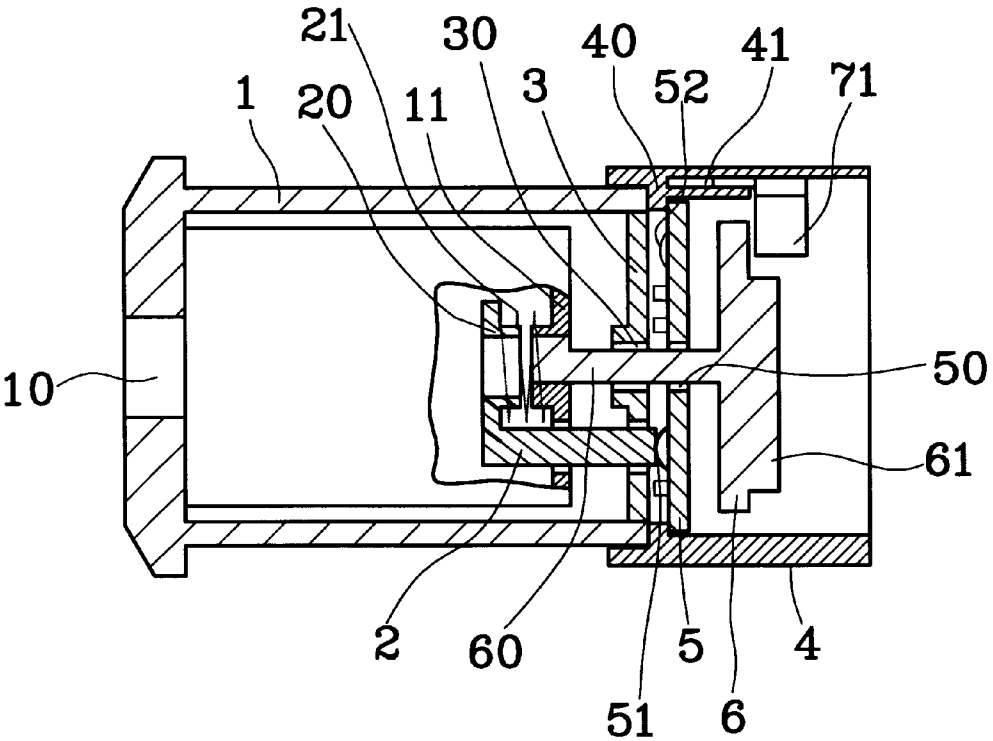
FIG. 4 is a schematic sectional view of the lock core mechanism with alarm function in the present invention being in a first condition that is abnormally unlocked so as to sound for alarm.
Figure 5A:
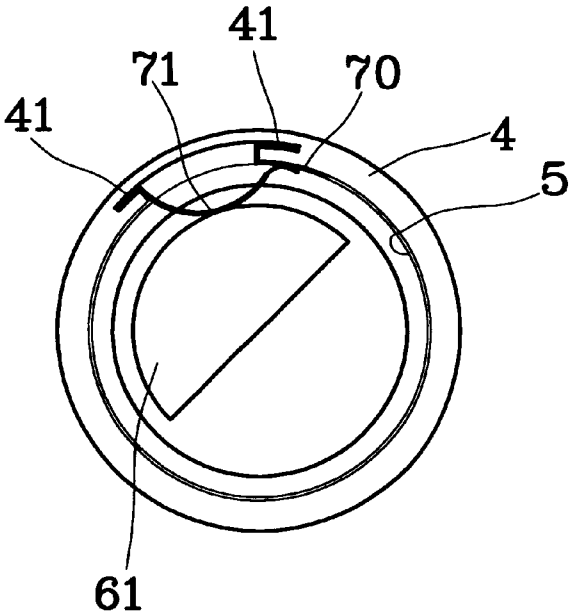
FIG. 5 is a schematic sectional view of the lock core mechanism with alarm function in the present invention being in a second condition that is abnormally unlocked so as to sound for alarm; and, FIG. 5A is a side view of FIG. 5 in the present invention.
Figure 5:
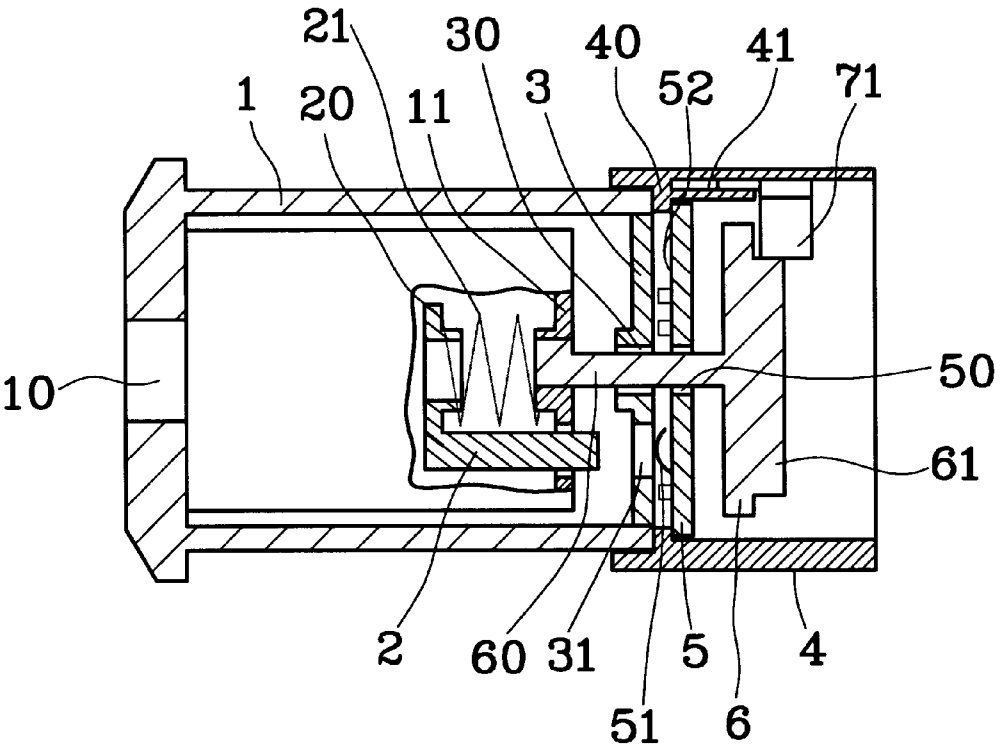

A preferred embodiment of a lock core mechanism with alarm function in the present invention, as shown in FIGS. 1, 2 and 2A, mainly includes a lock core body 1, a projecting rod 2, a core cover-plate 3, a housing 4, an electric circuit plate 5, a follower member 6 and an actuating elastic assembly 7.

The lock core body 1 has a keyhole 10 formed in one end thereof and a core plate 11 disposed proximate a rear portion therein. The core plate 11 capable of being rotated under a turning movement of a key has a combining hole 110 formed in a center thereof and a curved elongated hole 111 formed proximate a circumferential edge thereof.

The projecting rod 2 passing through the elongated hole 111 of the core plate 11 of the lock core body 1 has a retaining portion 20 disposed at an upper portion thereof and a spring 21 located between the retaining portion 20 of the projection rod 2 and the core plate 11 of the lock core body 1 and allowing the projecting rod 2 to move telescopically under a downward movement of a key.

The core cover-plate 3 fitly covered in one end of the lock core body 1 and extended through by the projecting rod 2.

The core cover-plate 3 has a through hole 30 disposed in a center thereof and an aperture 31 formed in one side thereof and provided to be extended through by the projecting rod 2.

The housing 4 connected with the lock core body 1 has a supporting ridge 40 disposed in an upper portion of an inner wall thereof and two opposite engagement grooves 41 disposed in the inner wall thereof and below the supporting ridge 40. The supporting ridge 40 has an upper surface adapted to be fitly rested against by a circumferential edge of a lower end of the lock core body 1.

The electric circuit plate 5 with buzzing function are firmly adhered to a bottom surface of the supporting ridge 40 of the housing 4 and has a through hole 50 formed in a center thereof, an actuating piece 51 disposed on one side thereof and corresponding in location to the projecting rod 2, and an alarm unit 52 disposed in a proper place thereon.

The follower member 6 accommodated in the housing 4 has an axle rod 60 extending upwards from an upper surface thereof, and a block 61 disposed on a lower surface thereof. The axle rod 60 passes through the electric circuit plate 5 and the core cover-plate 3, and then is firmly engaged with the core plate 11 of the lock core body 1.

The actuating elastic assembly 7 engaged in an inner wall of the housing has a contact member 70 and an elastic member 71 both capable of being inserted and firmly engaged in the two opposite engagement grooves 41. The contact member 70 is contacted with a circumferential edge of the electric circuit plate 5.

In assembling, referring to FIGS. 1, 2 and 2A, firstly extend the projection rod 2 through the elongated hole 111 of the core plate 11 of the lock core body 1, and then place the spring 21 between the retaining portion 20 of the projection rod 2 and the core plate 11 of the lock core body 1. Secondly, insert and engage the contact member 70 and the elastic member 71 of the actuating elastic assembly 7 respectively in the two opposite engagement grooves 41 of the housing 4 firmly. Thirdly, firmly adhere the electric circuit plate 5 to the bottom surface of the supporting ridge 40 of the housing 4 with the circumferential edge of the electric circuit plate 5 contacted with the contact member 70. Fourthly, pass the axle rod 60 of the follower member 6 through the through hole 50 of the electric circuit plate 5 and the through hole 30 of the core cover-plate 3 to make a top end of the axle rod 60 securely engaged with the combining hole 110 of the core plate 11. Fifthly, fitly cover the core cover-plate 3 in the end of the lock core body 1 with the aperture 31 aligned with the projecting rod 2. Finally, make the circumferential edge of the lower end of the lock core body 1 resting on and fixed to the upper surface of the supporting ridge 40, by which an assemblage of the whole structure of the lock core mechanism with alarm function in the present invention is completed.

In using, referring to FIGS. 2, 2A, 3 and 3A, when unlock the lock core mechanism of the present invention, a matching key is adapted to be inserted in the lock core body 1 with an end of the key pressing against the retaining portion 20 of the projecting rod 2 to make the retaining portion 20 of the projecting rod 2 compress the spring 21 so that the projecting rod 2 can pass through the aperture 31 of the core cover-plate 3 to touch against the actuating piece 51 of the electric circuit plate 5. At the same time, the key is further turned to rotate the core plate 11 to make the follower member 6 follow the rotation of the core plate 11 so that the block 61 of the axle rod 6 can roll over and press the elastic member 71 downwards to make the elastic member 71 to touch against the contact member 70, thereby preventing the electric circuit plate 5 from sounding.

However, if a non-matching key, such as a picking tool, is adapted to pick the lock core mechanism of the present invention, referring to FIGS. 4, 4A, 5 and 5A, the picking tool is inserted in the keyhole 10 of the lock core body 1 to extend into the interior of the lock core mechanism in which the picking tool may firstly presses against the retaining portion 20 of the projecting rod 2 and then push the projecting rod 2 downwards to pass through the aperture 31 of the core cover-plate 3 to touch against the actuating piece 51 of the electric circuit plate 5 without making the elastic member 71 touch against the contact member 70, thus activating the electric circuit plate 5 to sound for alarm.

In another case, if other special tools are inserted in the keyhole 10 of the lock core body 1 to turn the interior of the lock core mechanism to forcedly rotate the follower member 6 to press the elastic member 71 to touch against the contact member 70 without making the projecting rod 2 touch against the actuating piece 51, thus also activating the electric circuit plate 5 to sound for alarming and scaring thieves away.

Moreover, the lock core mechanism with alarm function in the present invention can be assembled in any locks, such as locks of gates, automobiles and safe deposit boxes, etc., to provide such locks with alarm function so as to increase the anti-theft effect.

While the preferred embodiment of the invention has been described above, it will be recognized and understood that various modifications may be made therein and the appended claims are intended to cover all such modifications that may fall within the spirit and scope of the invention.

What is claimed is:

1. A lock core mechanism with alarm function comprising:

a lock core body having a keyhole formed in one end thereof and a core plate disposed therein, said core plate capable of being rotated under a turning movement of a key and having a combining hole formed in a center thereof and an elongated hole formed proximate a circumferential edge thereof;

a projecting rod passing through said core plate of said lock core body and having a retaining portion disposed at an upper portion thereof and a spring located between said retaining portion of said projection rod and said core plate of said lock core body and allowing said projecting rod to move telescopically under a downward movement of said key;

a core cover-plate fitly covered in said lock core body and extended through by said projecting rod, said core cover-plate having a through hole and an aperture, said aperture provided to be extended through by said projecting rod;

a housing connected with said lock core body and having a supporting ridge disposed in an inner wall thereof;

an electric circuit plate fixedly attached to a bottom of said supporting ridge of said housing and having a through hole, an actuating piece corresponding in location to said projecting rod, and at least one alarm unit;

a follower member accommodated in said housing and having an axle rod extending upwards from an upper surface thereof and a block disposed on a lower surface thereof, said axle rod passing through said electric circuit plate and said core cover-plate, and then being firmly engaged with said core plate of said lock core body;

an actuating elastic assembly engaged in an inner wall of said housing and having a contact member and an elastic member, said contact member provided to be contacted with said electric circuit plate; and, whereby a combination of said components described above allows said electric circuit plate not to sound in a normal unlocking condition only when a matching key is inserted in said keyhole of said lock core body to press against said retaining portion of said projection rod to compress said spring to push said projection rod downwards to touch against said actuating piece of said electric circuit plate, and simultaneously turned to rotate said core plate to make said follower member roll over and press said elastic member downwards to touch against said contact member; otherwise, said electric circuit plate will sound for alarm when a picking tool is inserted to push said projecting rod downwards to touch against said actuating piece without making said elastic member touch against said contact member, or when a special tool is inserted to forcedly rotate said follower member to roll over and press said elastic member downwards to touch against said contact member without making said projecting rod touch against said actuating piece.

2. The lock core mechanism with alarm function as claimed in claim 1, wherein two opposite engagement grooves are disposed in an inner wall of said housing and below said supporting ridge for being inserted and engaged by said contact member and said elastic member of said actuating elastic assembly firmly.

* * * * *